US006128894A

United States Patent [19]

Joos et al.

[11] Patent Number: 6,128,894

[45] Date of Patent: Oct. 10, 2000

[54] METHOD OF OPERATING A BURNER

[75] Inventors: Franz Joos, Weilheim/Bannholz, Germany; Marcel Stalder, Klingnau, Switzerland

[73] Assignee: Asea Brown Boveri AG, Baden, Switzerland

[21] Appl. No.: 08/984,424

[22] Filed: Dec. 3, 1997

[30] Foreign Application Priority Data

Dec. 19, 1996 [DE] Germany ..... 196 53 059

[51] Int. Cl.[7] ..... F23R 3/28

[52] U.S. Cl. ..... 60/39.06; 60/737; 60/39.463; 431/6; 431/12

[58] Field of Search ..... 431/2, 4, 6, 12, 431/62; 60/737, 39.55, 39.06, 742, 39.463

[56] References Cited

U.S. PATENT DOCUMENTS

| | | | |
|---|---|---|---|
| 1,995,099 | 3/1935 | Herr . | |
| 2,319,591 | 5/1943 | Ferguson | 431/12 |
| 2,635,425 | 4/1953 | Thorpe et al. | 60/742 |
| 3,236,281 | 2/1966 | Bain et al. | 431/12 |
| 3,426,527 | 2/1969 | O'Connor | 60/742 |
| 3,764,071 | 10/1973 | Carlisle | 60/742 |
| 3,785,570 | 1/1974 | Krieger | 239/414 |
| 3,982,878 | 9/1976 | Yamane et al. | 431/2 |
| 4,201,553 | 5/1980 | Osborg | 44/52 |
| 4,293,230 | 10/1981 | Tan et al. | 366/101 |
| 4,443,180 | 4/1984 | LeFrois | 431/4 |
| 4,600,151 | 7/1986 | Bradley | 60/742 |
| 4,626,195 | 12/1986 | Sato et al. | 431/188 |
| 4,643,666 | 2/1987 | Green et al. | 431/4 |
| 4,655,706 | 4/1987 | Bayh, III | 431/187 |
| 5,137,444 | 8/1992 | Grebe et al. | 431/1 |
| 5,564,270 | 10/1996 | Kesseli et al. | 60/39.06 |
| 5,674,064 | 10/1997 | Francis, Jr. | 431/4 |
| 5,701,732 | 12/1997 | Nesbitt et al. | 60/742 |

FOREIGN PATENT DOCUMENTS

| | | |
|---|---|---|
| 552477 A1 | 7/1993 | European Pat. Off. . |
| 1282355 | 11/1968 | Germany . |
| 2300217 | 8/1973 | Germany . |
| 4446609 A1 | 6/1996 | Germany . |

OTHER PUBLICATIONS

"Atomization and Sprays", Lefebvre, Combustion: An International Series, 1989.

*Primary Examiner*—Ira S. Lazarus
*Assistant Examiner*—Sara Clarke
*Attorney, Agent, or Firm*—Burns, Doane, Swecker & Mathis, L.L.P.

[57] ABSTRACT

The invention is directed to a method of operating a burner. The method includes feeding an auxiliary gas into a liquid fuel upstream of an injection orifice during the ignition and during part load of the burner, and interrupting the feeding of the auxiliary gases within high load ranges of the burner.

11 Claims, 1 Drawing Sheet

METHOD OF OPERATING A BURNER

BACKGROUND OF THE INVENTION

1. Field of the Invention

The invention relates to a method of operating a burner.

2. Discussion of Background

So-called solid-jet atomizers, inter alia, are used in order to atomize liquid fuels. In such a nozzle, the liquid fuel is ejected under high pressure from a prechamber through a circular injection orifice of a certain guide length. The resulting fuel jet disintegrates in a more or less static environment to form a fine spray. In order to produce a sufficiently fine spray for the combustion, however, a relatively high fuel pressure is required, as is applied only during full load of a gas-turbine plant. On the other hand, on account of the low fuel flow rate, only a low fuel pressure is required, for example, during the ignition of a combustion chamber or when running the plant up to speed after the ignition. However, since the atomization of the liquid fuel by means of a solid-jet atomizer naturally leads to relatively large droplets during part load of the gas-turbine plant, the conventional solid-jet atomizers are not suitable for the part-load operation of a gas-turbine plant.

In order to nonetheless obtain fine droplets, the nozzle may additionally be provided with a so-called ignition stage. This ignition stage is a second atomizer which is designed for correspondingly low flow rates and therefore ensures sufficiently fine atomization of the liquid fuel during part load. Such a solution is disclosed by the textbook "Atomization and sprays", by A. Lefebvre, West Lafayette, Ind. 1989, page 120, FIG. 4.21. However, this nozzle, with its two fuel feed lines and with two fuel ducts which lie radially one above the other and to which fuel is admitted according to the fuel mass flow required, requires a relatively large construction space. In addition, the components used are naturally of intricate design, as a result of which the nozzle is more susceptible to trouble. The use of more than two atomizers in one nozzle adds to said disadvantages. In addition, a corresponding number of fuel feed lines with various control valves are necessary, as a result of which not only the design input but also the costs increase. During changeover to the atomizer required in each case, discontinuity occurs in the fuel flow and this may lead to extinction of the burner.

Also disclosed by the textbook "*Atomization and sprays*", by A. Lefebvre, West Lafayette, Indiana 1989, on pages 142–144 and FIG. 4.50, is an atomizer. for liquid fuels, in which atomizer an auxiliary gas is introduced into the liquid flow upstream of the injection orifice. To this end, a gas tube is arranged in the interior of the liquid-fuel tube, which gas tube ends upstream of the injection orifice and is provided with a plurality of discharge orifices for the auxiliary gas. The auxiliary gas is injected into the liquid flow at a low velocity and at a pressure only marginally higher than that of the liquid flow. The auxiliary gas issuing into the liquid forms gas bubbles, the effect of which is to produce relatively thin shreds and ribbons of liquid in the liquid flow. Since such liquid flows of smaller diameter are easier to break up into a fine spray, the atomization of the liquid fuel is improved in this way. The total volumetric flow to be atomized is increased by the injection of the auxiliary gas into the liquid-fuel tube, so that sufficient atomization of the fuel can be achieved by means of a solid-jet atomizer even during part load.

The disadvantage of such an atomizer, however, is that it cannot be used during full load of the gas-turbine plant, i.e. at high fuel pressure. In order to ensure the injection of the auxiliary gas into the liquid fuel and thus the operability of the atomizer during this operating state, the auxiliary gas must be highly compressed. However, this is very expensive and is not possible without an external supply of energy. Therefore such atomizers have not been widely adopted hitherto.

SUMMARY OF THE INVENTION

Accordingly, one object of the invention, in attempting to avoid all these disadvantages, is to provide a simple method of operating a burner, which method is suitable for all operating states.

According to the invention, this is achieved in a method in that which the auxiliary gas is fed only during the ignition and during part load of the burner and the feeding is interrupted within high load ranges.

The atomizer nozzle, which is known per se, can now be adapted in an optimum manner not only to ignition and low load conditions but also under high load conditions and of course during full load. In this way, the respective range of use of such an atomizing nozzle or a burner equipped with it is considerably widened. Only in this way is its use in a combustion chamber operated with varying combustion-air pressures, such as in the case of a gas turbine for example, made possible.

In general, lower emission combustion can be achieved by the premixing, taking place in the burner, of the liquid fuel with the auxiliary gas. An additional advantage is obtained when using the method in axially mounted combustion chambers in which the burners are arranged at different geodetic heights. By the feeding of the auxiliary gas, the uneven distribution of the liquid fuel, which otherwise occurs in particular during the ignition, can be markedly reduced and thus the operability of the combustion chamber can be increased.

It is especially expedient if the auxiliary gas continues to be fed even when the supply of liquid fuel to the burner is interrupted. In this way, the atomizing nozzle can additionally be purged and thus its carbonization prevented.

Furthermore, it is advantageous if the auxiliary gas is delivered to the burner from a pressure vessel or an auxiliary compressor. In accordance with the actual conditions of use of the burner, there is therefore a suitable source for the auxiliary gas in each case.

Compressed air is fed as auxiliary gas in an especially advantageous manner. When required, either ambient air is compressed or compressed air from the pressure vessel, which is already filled before the ignition of the burner, is used for this purpose. The use of ambient air as auxiliary gas is especially favorable because it is always available.

Depending on availability, the invention may also be realized with inert gases, such as nitrogen for example, with ignition gases (e.g. propane) or with fuel gases (e.g. natural gas).

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein the single figure shows a partial longitudinal section of a burner for liquid fuels which is equipped with an atomizing nozzle and is arranged in a gas-turbine plant.

Only the elements essential for understanding the invention are shown. Elements of the plant which are not shown are, for example, the compressor and the gas turbine. The direction of flow of the working media is designated by arrows.

DESCRIPTION OF THE PREFERRED EMBODIMENTS

Figure 1:
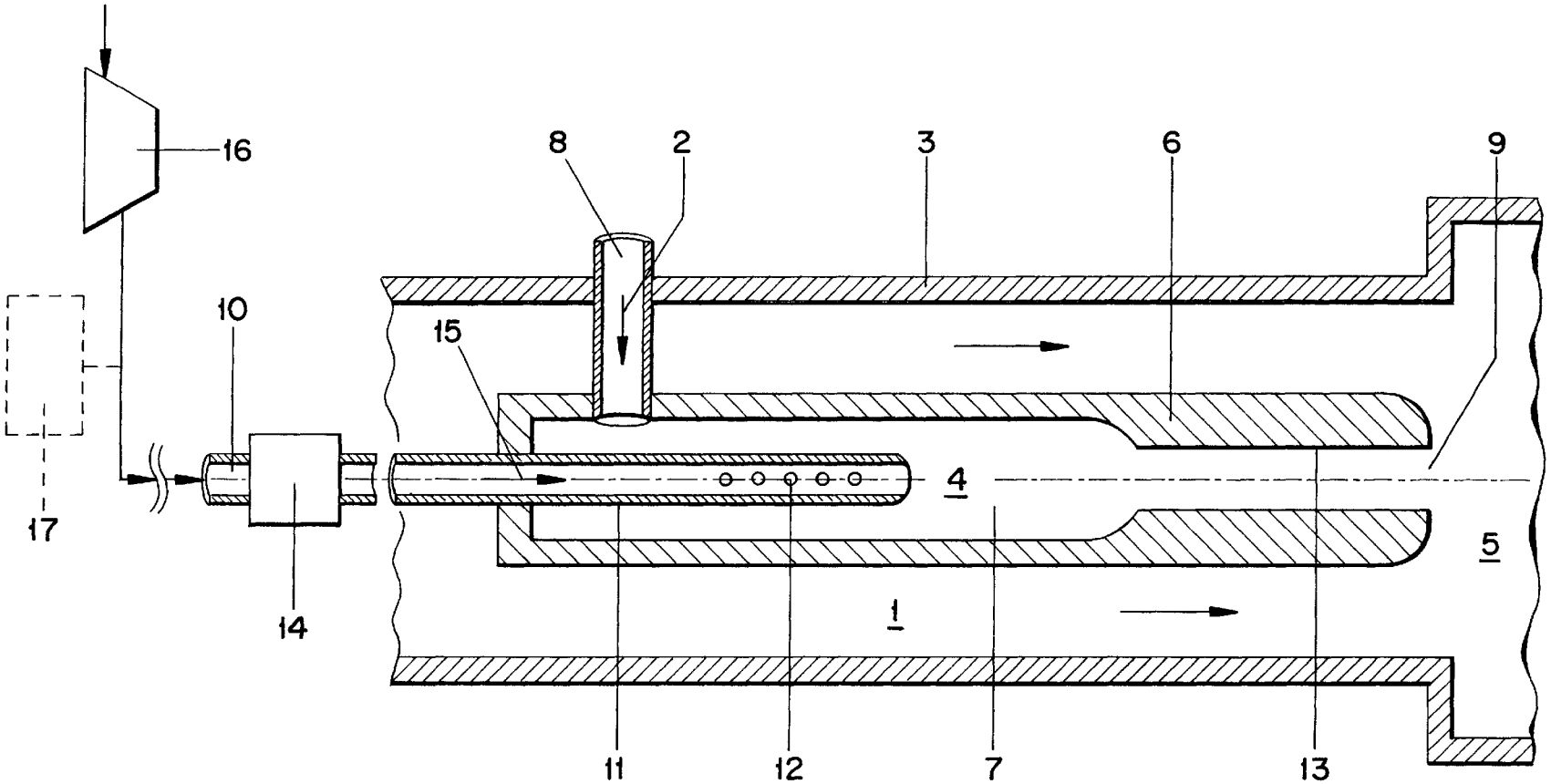

Referring now to the drawing, a plurality of burners 1 are arranged in the gas-turbine plant (not shown) and are operated with a liquid fuel 2, more precisely fuel oil. Other suitable fuels may of course also be used.

Each burner 1 consists of an outer air tube 3 and an atomizing nozzle 4 arranged coaxially in the interior of the air tube 3, both the air tube 3 and the atomizing nozzle 4 leading into a combustion chamber 5 of the gas-turbine plant. The atomizing nozzle 4 has a liquid-fuel tube 6 with an interior space 7, a fuel feed line 8, and a circular injection orifice 9. Arranged in the interior space 7 of the atomizing nozzle 4 is a gas tube 11, which is connected to a feed line 10 and has a plurality of discharge orifices 12 leading into the interior space 7. The interior space 7 is narrowed in the direction of the injection orifice 9, i.e. it is formed with a guide piece 13 for the fuel oil 2. The feed line 10 has a control valve 14 with which the gas tube 11 can be opened or blocked.

During operation of the gas-turbine plant, each burner 1 is supplied with fuel oil 2 via the corresponding fuel feed line 8. In the process, the fuel oil 2 first of all passes into the interior space 7 of the liquid-fuel tube 6, where it is delivered further by the fuel pressure in the direction of the injection orifice 9. During both the ignition action and the part-load operation of the burners 1 or the gas-turbine plant, compressed air, serving as auxiliary gas 15, is directed into the fuel oil 2 in the interior space 7 via the feed line 10 and the discharge orifices 12 arranged in the gas tube 11. This injection is effected at a low velocity and at a pressure of about 0.1 to 3.0 bar, which is only marginally. The volumetric flow and thus the fuel pressure are increased by the additional air 15, so that improved atomization of the fuel oil 2 can be achieved even during both the ignition action and the part-load operation of the burners 1. In addition, the auxiliary gas 15 entering the liquid fuel oil 2 forms air bubbles, the effect of which is to squeeze the fuel oil 2 into the form of thin shreds and ribbons of liquid fuel. Since the individual portions of the fuel oil 2 therefore have a relatively small initial diameter, especially fine atomization can be achieved when injecting the fuel oil 2 through the injection orifice 9.

The air serving as auxiliary gas 15 is extracted in a precompressed state from the compressor section of the gas-turbine plant and, if required, is brought to the requisite pressure via an auxiliary compressor 16. The air 15 may of course also be fed from a pressure vessel 17.

With increasing load of the gas-turbine plant, the fuel flow rate through the burner 1 steadily increases. In a similar manner to the fuel flow rate, the fuel pressure in the burner 1 and in the atomizing nozzle 4 increases. When the fuel pressure required for sufficient atomization is reached, the air feed is interrupted by closing the control valve 14. As can be appreciated by one of ordinary skill in the art, the control valve 14 is re-opened when the fuel pressure is lowered. When the control valve 14 is closed, i.e. during high fuel pressure, the fuel oil 2 is divided by means of the circular injection orifice 9 into a fine spray suitable for the combustion.

Air 15 continues to be fed to the burner 1 even during an interruption in the supply of liquid fuel 2 to the burner 2, e.g. during temporary use of the burner 1 as ignition burner or pilot burner or as stage burner of a sequential combustion chamber, or when the gas-turbine plant is being shut down. In. this way, purging of the atomizing nozzle 4 is ensured and its carbonization is thus prevented.

Other auxiliary gases, such as, inert gases (nitrogen) or ignition gases (propane) or fuel gases (natural gas), may of course also be used as an alternative to the air 15 used.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of operating a gas turbine burner comprising the steps of:

directing a liquid fuel having a fuel pressure into an atomizing nozzle of the gas turbine burner;

introducing an auxiliary gas having a pressure higher than the fuel pressure into the liquid fuel during an ignition and a part load condition of the gas turbine burner;

interrupting the introduction of auxiliary gas into the liquid fuel during a high load range of the gas turbine burner; and ejecting the liquid fuel through an injection orifice of the gas turbine burner;

wherein the step of introducing the auxiliary gas further includes continuing to feed the auxiliary gas when the supply of liquid fuel to the gas turbine burner is interrupted.

2. The method as claimed in claim 1, wherein the step of introducing the auxiliary gas further includes delivering the auxiliary gas to the gas turbine burner from a pressure vessel or an auxiliary compressor.

3. The method as claimed in claim 2, wherein compressed air is fed as the auxiliary gas.

4. The method as claimed in claim 3, wherein ambient air is the auxiliary gas and the ambient air is compressed and delivered to the gas turbine burner during the ignition and/or the part-load operation of the gas turbine burner.

5. The method as claimed in claim 2, wherein compressed air is the auxiliary gas and the compressed air is delivered to the gas turbine burner from a pressure vessel filled before the ignition of the gas turbine burner.

6. The method as claimed in claim 2, wherein nitrogen is delivered as the auxiliary gas to the gas turbine burner.

7. The method as claimed in claim 2, wherein propane is delivered as said auxiliary gas to the gas turbine burner.

8. The method as claimed in claim 2, wherein natural gas is used as said auxiliary gas.

9. The method as claimed in claim 1, wherein said auxiliary gas has a low velocity when it is introduced into the liquid fuel.

10. A method of operating a gas turbine burner comprising the steps of:

directing a liquid fuel having a fuel pressure into an atomizing nozzle of the gas turbine burner;

introducing an auxiliary gas having a pressure higher than the fuel pressure into the liquid fuel during an ignition and a part load condition of the gas turbine burner and continuing to feed the auxiliary gas when a supply of liquid fuel to the gas turbine burner is interrupted;

interrupting the introduction of auxiliary gas into the liquid fuel during a high load range of the gas turbine burner; and ejecting the liquid fuel through an injection orifice of the gas turbine burner.

11. The method as claimed in claim 10, wherein said auxiliary gas has a low velocity when it is introduced into the liquid fuel.

* * * * *